United States Patent [19]

Giggard

[11] 4,032,064

[45] June 28, 1977

[54] BARRIER BAG ASSEMBLY FOR AEROSOL CONTAINER

[75] Inventor: Earl D. Giggard, Clarendon Hills, Ill.

[73] Assignee: The Continental Group, Inc., New York, N.Y.

[22] Filed: Jan. 5, 1976

[21] Appl. No.: 646,458

[52] U.S. Cl. ..... 229/55; 220/85 B; 222/95

[51] Int. Cl.[2] ..... B65D 33/02

[58] Field of Search ..... 222/94, 95, 96, 386.5; 220/85 B, 63 R; 229/55

[56] References Cited

UNITED STATES PATENTS

| | | | |
|---|---|---|---|
| 1,227,751 | 5/1917 | Cobb | 222/95 X |
| 2,557,162 | 6/1951 | Wetzel et al. | 222/95 X |
| 2,721,580 | 10/1955 | Greer | 220/63 R X |
| 2,789,731 | 4/1957 | Marraffino | 222/94 X |
| 3,905,517 | 9/1975 | Friedrich et al. | 222/386.5 X |

*Primary Examiner*—Stephen P. Garbe
*Attorney, Agent, or Firm*—John J. Kowalik; Joseph E. Kerwin; William A. Dittmann

[57] ABSTRACT

A barrier bag of suitable plastic material which has a rigid sloping bottom and thin side walls, the shape and strength of the bottom and the top of the bag causing the body of the bag to collapse radially and fold in a desired manner about a dip tube in the bag without paneling such as would prevent evacuation of the product from the bag.

9 Claims, 8 Drawing Figures

BARRIER BAG ASSEMBLY FOR AEROSOL CONTAINER

DISCUSSION OF THE PRIOR ART

This invention relates to barrier bags in aerosol cans. Various attempts have been made to solve the "paneling" problem, namely, the undesired collapse of the side walls of the bag between the bottom and the nozzle of the can, and thus traps a portion of the product at the bottom of the bag and prevents its being discharged.

Designs incorporating radial flutes as well as axial flutes in the bag have met with varying success and have added inordinately to the cost of the bag.

SUMMARY OF THE INVENTION

The invention concerns a bag which is of simple design, easy to fabricate and in which folding of the side wall of the bag is controlled by the shapes and structure of the bottom and the top of the bag.

A primary object is to provide a bag for a pressurized product-dispensing container which comprises a relatively thin walled body portion and flex-resistant end portions constructed to induce radial folding of the body portion without paneling during exhaustion of product from the bag.

A further object is to provide a plastic bag for an aerosol container having a simple essentially cylindrical body section and pre-shaped fold-controlling end portions to induce the bag to fold radially essentially when the product is squeezed out or aspirated from the bag.

Specifically, the invention contemplates providing a flexible bag having a bottom formed non-perpendicular to the axis of the bag and being thicker than the side wall of the bag so as to provide unequal axial dimensions of the side wall of the bag whereby the longer sections of the side wall are more flexible and thus will collapse inwardly as the product is exhausted from the bag and the pressurized gas causes the side wall sections to collapse radially inwardly.

These and other objects and advantages inherent in and encompassed by the invention will become more readily apparent from the specification and the drawings, wherein:

FIG. 1A is a fragmentary enlarged cross section of the upper portion of the bag;

Figure 8:
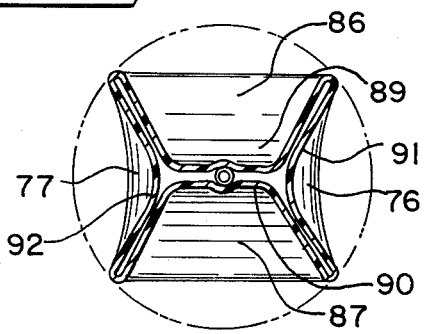
Figure 2:
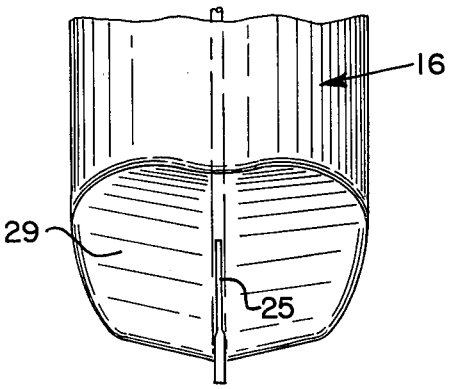
FIG. 2 is a fragmentary side elevational view taken substantially on line 2—2 of FIG. 1.
Figure 6:
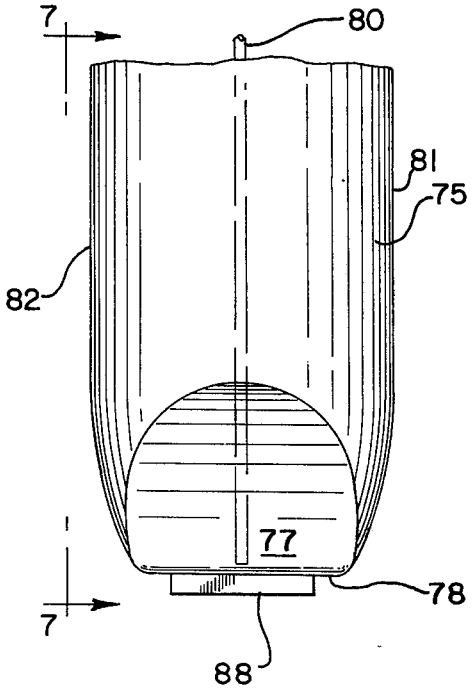
Figure 7:
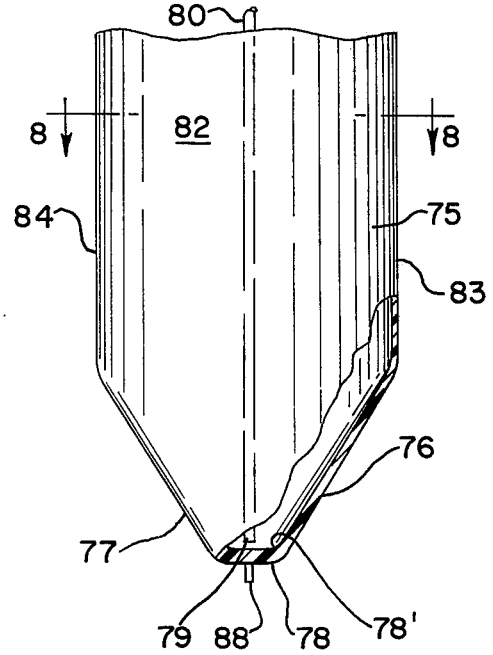

FIGS. 6, 7, and 8 illustrate a modification;

FIG. 6 being a fragmentary side elevational view and

FIG. 7 being a further side elevation taken substantially on line 7—7 of FIG. 6.

FIG. 8 is a cross-sectional view taken substantially on line 8—8 of 7.

DESCRIPTION OF THE INVENTION

FIGS. 1–5

The invention is disclosed in connection with a typical metal aerosol can 2 comprising a cylindrical body 4, a bottom 5 and a dome type upper end member 6 terminating in a reducedneck 8 within which there is pressed an end member or cap 10 which has an axial wall portion 12 securing about the curl 14 the upper neck portion 15 of a barrier bag 16.

The bag 16 may be of any known plastic materials such as polyethylene, polypropylene or laminates with metal foil (aluminum) or other barrier materials such as saran, mylar, etc. The neck of the bag is formed integral with a frusto-conical transition portion 18 which is essential complemental to the shape of the end member 6 and fits thereinto. The lower edge of the portion 18 merges into the upper end of a cylindrical body section 20 of the bag and the body section is integral with a bottom end portion 22.

Figure 4:
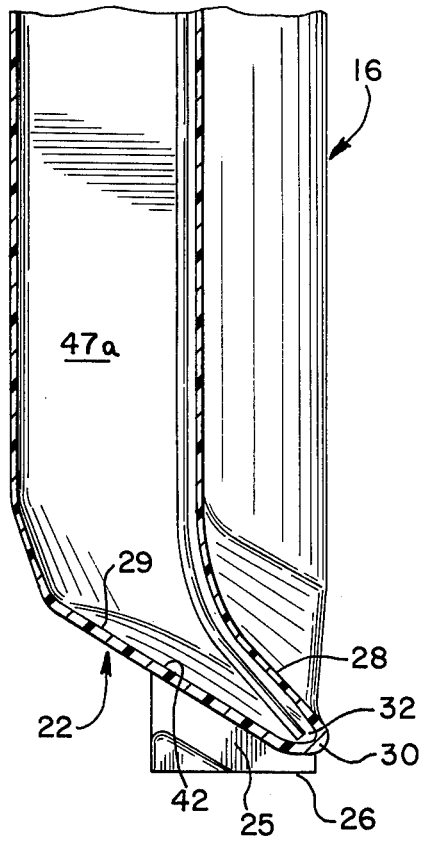
FIG. 4 is a fragmentary sectional view taken substantially on line 4—4 of FIG. 3.

It will be observed that the upper portion 18 becomes progressively thicker toward the neck and that the body portion is substantially thinner than the bottom 22 which is the thickest part of the bag. The bottom gradually thins out about its periphery into the body portion and is provided with an external spine 25 made from the stock material of the bag and extending axially of the bag on its axis and terminating in a straight lower edge 26 which extends normal to the axis of the bag. The spine or rigidifying panel 25 extends from the longest side of the bag toward its shortest side and is somewhat trapezoidal in side elevation as seen in FIG. 4. The bottom is actually formed with two downwardly converging segments 28, 29 which terminate in an apex 30 providing a well 32 (FIG. 4) in the lowermost section of the bag. It will be seen that the apex is eccentrically positioned and that section 28 is of shorter length than section 29. Section 28 also is formed from the thin side wall and thus is more flexible than the primary bottom section 29. Section 28 is inclined to the axis of the bag between 15° and 30° whereas the portion 29 is inclined at about 40°–50° preferably about 45° to the axis.

It will be observed that in this embodiment the portion 29 extends through the axis of the container on which there is disposed the gas valve 35 in the bottom end member 5 and through which there is inserted a needle (not shown) for filling the container with pressurized gas. The inclination of the bottom 29 facilitates needle insertion and being of thick section is puncture proof and provides a bottom guide surface 36 against which the needles, if inserted too deeply, may be guided laterally.

Figure 5:
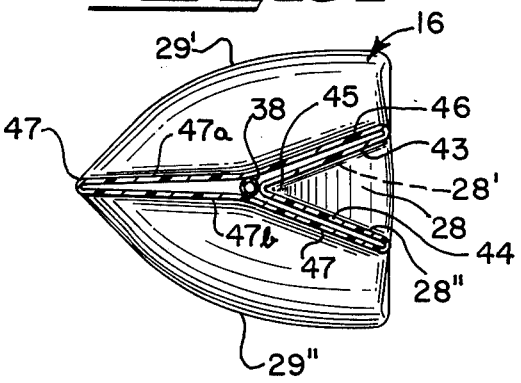
FIG. 5 is a cross-sectional view taken substantially on line 5—5 of FIG. 3.

In the embodiment of this invention, there is shown a dip tube 38 which has its lower end positioned in the apex or well 32 and its upper end connected to the discharge valve 40 of conventional construction. As the product becomes exhausted from the bag, the sides of the bag collapse radially inwardly such that the bottom portion 28 is swung about the apex inwardly toward the top side 42 of the portion 29 as best seen in FIG. 4 and assumes a triangular shape as seen in FIG. 5. This causes two circumferentially adjacent sections 43, 44 of the body wall to fold along an axial line coinciding with the apex 45 of the section 28 and also causes two flanking portions 46, 47 to fold inwardly. Portion 46 and portion 47 converge inwardly with sections 47*a* and 47*b* thereby defining a Y shaped cross-sectional configuration as seen in FIG. 5. A dip tube 38 is captured at the juncture of each of the legs and stem of the Y. Immediately above the bottom section 28, a similar triangular section 49 is developed which is conducive to the folding heretofore described. The self forming folds thus tend to hold the bag from collapsing readily axially and thus the tube remains in the bottom of the bag to properly drain the product from the bag.

EMBODIMENT OF FIGS. 6–8

In the embodiment of FIGS. 6–8, the bag side wall 75 is cylindrical and thin as in the previous embodiment and the two converging bottom sections 76, 77 are equally thick and substantially thicker than the side wall.

Each bottom section converges toward the axis of the bag between 25° to 40° into a bottom apex 78 which defines a well 78' into which extends the bottom or inlet end 79 of a dip tube 80 as in the previous embodiment and is attached similarly to a valve (not shown). In this embodiment, the upper portion of the bag is identical with that shown in FIGS. 1–5 and the bag is similarly positioned within a metal, preferably steel, container.

Figure 1:
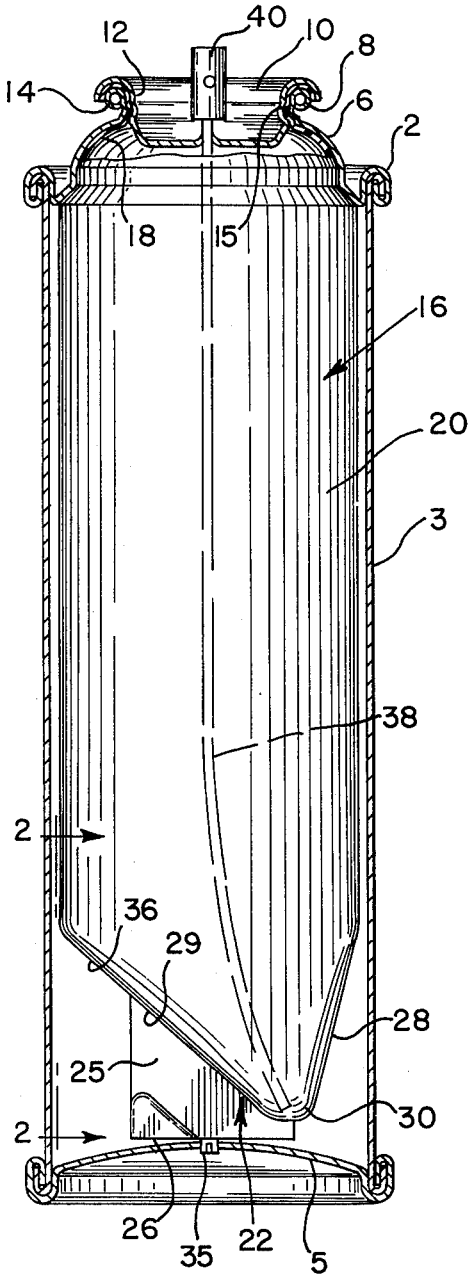
FIG. 1 is an axial sectional view of a container incorporating the invention shown in side elevation.
Figure 3:
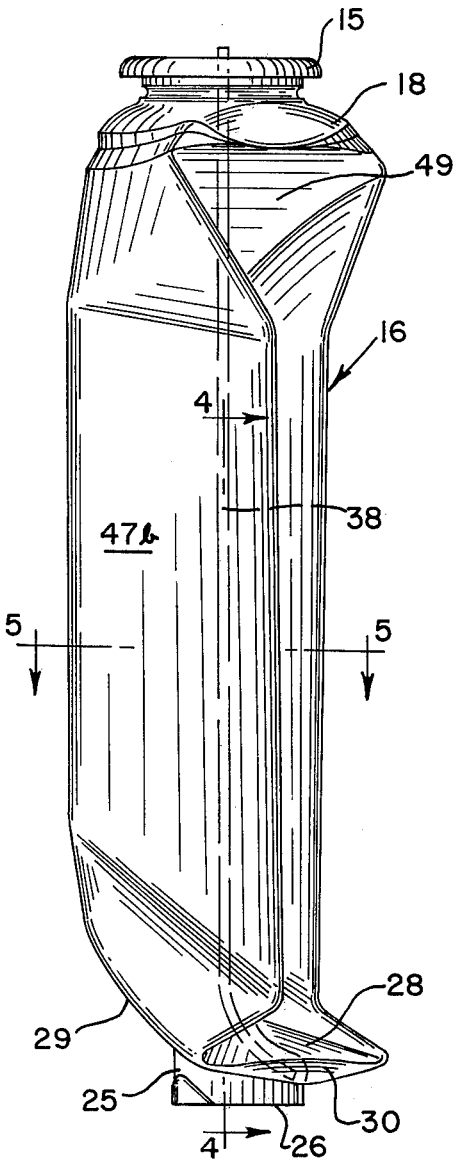
FIG. 3 is a side elevation of the plastic bag shown in collapse condition.

As the product is exhausted, the sides of the bag collapse or fold inwardly between the two bottom walls each forming an inward V. In the present instance, the longer lengths of side wall portions 81, 82 are more flexible than the shorter intervening lengths 83, 84 and thus the longer portions will start to fold inwardly first forming upper and lower triangular sections 86, 87 as in the previous embodiment, the bottom is drawn up but the dip tube as seen in FIG. 3 will bend up and slide off-center to one end or the other of the apex 77 which also is reinforced by a bisecting spine 88 or plate of the stock material from which the bag is made.

It will be seen that essentially each bottom in both embodiments have two sections each assuming generally triangular form when the container is collapsed. The triangular sections are joined at their base edges to each other at the apex juncture and as seen in FIG. 5, the section 28 is similar to section 29 and side edges 28' and 28'' are generally parallel with side edges 29', 29'.

In this embodiment the half moon shaped bottom sections become more or less triangular during collapse of the bag and fold at their base edges at the apex toward each other which essentially occurs in the first embodiment except that the folding is different as best seen in FIG. 8 wherein there are four lengthwise folds 89, 90, 91 and 92 developed in a generally X-shaped cross-sectional configuration, the portions 76, 77 folding inwardly by hinging at the apex 78.

Thus in each embodiment the inclined portions, the spine and the added thickness of the bottom as well as the bell shape of the top of the bag are conducive to folding of the cylindrical body portion radially inwardly in a controlled manner without paneling.

Having described several forms of the invention, it will be apparent that other shapes and constructions will become apparent to those skilled in the art which fall within the scope of the appended claims.

What is claimed is:

1. A plastic bag for an aerosol container comprising a generally cylindrical collapsible body and top and bottom end members, and means on said bottom member for resisting collapse of the bottom member upon the imposition of pressure on the body and bottom member, said body having portions adapted to fold in radially and the top end member of said bag being generally frusto conical and having an upper neck portion and gradually becoming thinner toward its juncture with the upper end of the body portion and being collapsible therewith inwardly.

2. A plastic bag for an aerosol container comprising a generally cylindrical collapsible body and top and bottom end members, and means on said bottom member for resisting collapse of the bottom member upon the imposition of pressure on the body and bottom member, said body having portions adapted to fold in radially and said bottom member being formed of essentially two portions one of which slopes downwardly at a steeper angle than the other and said steeper angled portion being of thinner section that the other and upon exhaustion of product from the bag being adapted to form a generally triangular segment overlapping the other bottom portion and one edge of said segment forming a lower edge of the other portion and said segment having two other sides edges forming a juncture with lower ends of said portions of the body wall folded in by the pressure as product is exhausted from the bag.

3. A plastic bag for an aerosol container comprising a generally cylindrical collapsible body and top and bottom end members, and means on said bottom member for resisting collapse of the bottom member upon the imposition of pressure on the body and bottom member, said body having portions adapted to fold in radially and said bottom having two segments joined in a downwardly directed apex, one segment being dimensionally smaller than the other segment and being foldable thereover and affecting folding of adjacent sections of the side wall of the body portion inwardly of the bag, and the side edges of the larger bottom segment controlling inward deflection of portions of the body flanking said sections to a position embracing the folded sections.

4. A plastic bag for an aerosol container comprising a generally cylindrical collapsible body and top and bottom end members, and means on said bottom member for resisting collapse of the bottom member upon the imposition of pressure on the body and bottom member, said body having portions adapted to fold in radially and a spine integrally formed on the bottom of said bag.

5. The invention according to claim 4 and said spine being in the form of a fin extending flatwise axially of the container.

6. The invention according to claim 5 and said spine being located solely upon said apex and depending from said bottom.

7. The invention according to claim 4 and said bottom having angularly related portions joined in an apex and said spine bisecting the apex.

8. The invention according to claim 4 and said body portion being foldable into a generally Y-shaped configuration.

9. The invention according to claim 4 and said body portion being foldable into a generally X-shaped configuration.

* * * * *